US005172108A

United States Patent [19]

Wakabayashi et al.

[11] Patent Number: 5,172,108

[45] Date of Patent: Dec. 15, 1992

[54] MULTILEVEL IMAGE DISPLAY METHOD AND SYSTEM

[75] Inventors: Toshiro Wakabayashi; Hiroshi Hada, both of Tokyo, Japan

[73] Assignee: NEC Corporation, Tokyo, Japan

[21] Appl. No.: 840,583

[22] Filed: Feb. 24, 1992

Related U.S. Application Data

[63] Continuation of Ser. No. 311,101, Feb. 15, 1989, abandoned.

[30] Foreign Application Priority Data

Feb. 15, 1988 [JP] Japan ..... 63-32186

[51] Int. Cl.[5] ..... G09G 3/00

[52] U.S. Cl. ..... 340/793; 340/767

[58] Field of Search ..... 340/793, 703, 723, 802, 340/803, 804, 805, 811, 767, 771, 760, 765, 713, 784; 358/165; 315/169.4; 328/129.1

[56] References Cited

U.S. PATENT DOCUMENTS

| | | | |
|---|---|---|---|
| 4,649,432 | 3/1987 | Watanabe et al. | 340/793 |
| 4,654,649 | 3/1987 | Kojima et al. | 315/169.4 |
| 4,703,317 | 10/1987 | Shiomi et al. | 340/703 |
| 4,779,083 | 10/1988 | Ishii et al. | 340/707 |
| 4,827,255 | 5/1989 | Ishii | 340/703 |
| 4,841,259 | 6/1989 | Kambayshi | 340/703 |
| 4,859,998 | 8/1989 | Kawamura et al. | 340/793 |

*Primary Examiner*—Alvin E. Oberley
*Assistant Examiner*—Chanh Nguyen
*Attorney, Agent, or Firm*—Laff, Whitesel, Conte & Saret

[57] ABSTRACT

A method for displaying an image with multilevel brightness by using an image display device in which an image is displayed by sequentially activating scan lines one by one, and one complete display image is formed by at least a plurality of continuous frames or fields. A brightness of the whole of the display screen is changed in units of one frame or field, so that each display pixel can have brightness levels which are respectively defined by combinations of brightness levels given by an input display data and brightness levels of the whole of the display screen.

5 Claims, 4 Drawing Sheets

MULTILEVEL IMAGE DISPLAY METHOD AND SYSTEM

This application is a continuation of application Ser. No. 07/311,101 filed Feb. 15, 1989 now abondoned.

BACKGROUND OF THE INVENTION

1. Field of the invention

The present invention relates to a multilevel image display method, and more specifically to a method and system for displaying a multilevel image by using a binary display apparatus.

2. Description of related art

Drive circuits for two-dimensional display panels such as plasma display panels, liquid crystal display panels, and LED (light emitting diode) display panels are constructed to selectively drive, on the basis of a given display data, a plurality of row electrodes and a plurality of column electrodes which are arranged orthogonal to each other.

FIG. 1 shows a block diagram of one conventional typical drive circuit for the two-dimensional display panel. The shown circuit includes a shift register 10 having a serial input connected to a data input port 12 so that a display data D is serially inputted through the input port 12 to the shift register 10 in synchronism with a clock pulse CK, so that the display data corresponding to one horizontal line or row is accumulated in the shift register 10. The shift register 12 having parallel outputs connected to a latch circuit 14, so that the display data of one horizontal line or row accumulated in the shift register 10 is transferred in parallel to and latched by the latch circuit 14 in synchronism with a horizontal scan or synchronism signal Hs and held in the latch circuit 14 during each one horizontal scan period. Each bit of the latch circuit 14 is connected to an input of a corresponding column driver 16, which applies or does not apply a voltage to a corresponding column electrodes 18 of a display panel 20 in accordance with a binary value held in the corresponding bit of the latch circuit 14.

The shown drive circuit also includes a row signal generator 22 connected to receive the horizontal scan or synchronism signal Hs and having a plurality of parallel outputs, which are connected through row drivers 24 to corresponding row electrodes 26 of the display panel 20. Thus, the row signal generator 22 responds to the horizontal scan or synchronism signal Hs so as to selectively activate only one of the parallel outputs for each one horizontal scan period so that only the row driver connected to the activated output of the row signal generator 22 applies a voltage to the corresponding one row electrode.

With the arrangement as mentioned above, display data D is inputted through the input port 12 to the shift register 10 in synchronism with the clock pulse CK so that the display data D corresponding to one horizontal scan period or line is accumulated in the shift register 10. The accumulated display data of one horizontal scan line is latched to the latch circuit 14 in synchronism with the horizontal scan signal Hs. For a next horizontal scan period, each of the column drivers 16 connected to the latch circuit 14 applies a voltage corresponding to the binary value held in the corresponding bit of the latch circuit 14, to the corresponding column electrode 18 of the display panel. On the other hand, the row signal generator 22 sequentially activates the row electrodes through the row drivers 24, one electrode by one electrode, in synchronism with the horizontal scan signal Hs. As a result, of intersecting points 28 between the activated row electrode 26 and all the column electrodes 18, intersecting points on column electrodes corresponding to binary display data of "1" is fired by a potential difference between the voltage applied to the column electrodes and the voltage applied to the activated row electrode. However, intersecting points on column electrodes corresponding to binary display data of "0" is not fired since these intersecting points are applied with only the voltage applied to the activated row electrode. Thus, an image is indicated on the display panel in accordance with the input display data D.

In the above mentioned display system, however, the display panel is of the binary display type so that each intersecting point (display pixel or dot) between the row electrodes and the column electrodes is simply fired in an ON/OFF manner by the associated drivers in accordance with the input display data. In other words, it is not possible to modify the brightness of the display pixel or dot, and therefore, a displayed image or picture having a multilevel brightness cannot be obtained.

SUMMARY OF THE INVENTION

Accordingly, it is an object of the present invention to provide a display method and system which has overcome the above mentioned defect of the conventional one.

Another object of the present invention is to provide a display method and system which can realize a multilevel brightness image display while using a binary display device.

The above and other objects of the present invention are achieved in accordance with the present invention by a method for displaying an image in a multilevel manner by using an image display device in which an image is displayed by sequentially activating scan lines one by one, and one complete display image is formed by at least a plurality of continuous frames or fields, comprising the step of changing a brightness of the whole of the display screen in units of one frame or field, so that each display pixel can have brightness levels which are respectively defined by combinations of brightness levels given by an input display data and brightness levels of the whole of the display screen.

Even in a binary image display device, the brightness of the whole of the display screen can be easily modified or changed. Therefore, as mentioned above, if the brightness of the whole of the display screen is changed in units of one frame or field, the display pixels or dots can have brightness levels which are defined by not only the brightness levels given by an input display data but also by the brightness levels of the whole of the display screen. Thus, one complete displayed image formed by at least a plurality of continuous frames or fields can be indicated with a brightness.

According to another aspect of the present invention, there is provided a circuit for driving, in a multilevel manner, a binary image display device in which an image is displayed by sequentially activating scan lines one by one, and one complete display image is formed by at least first and second continuous alternating frames or fields of display data, the image display device having a plurality of row electrodes and a plurality of column electrodes intersecting to one another in a two-dimensional plane so that each of intersecting points between the row electrodes and the column electrodes froms one pixel, comprising a data selector connected to receive the first and second continuous alternating frames or fields of display data, respectively, a counter connected to receive a vertical synchronism signal for counting the received vertical synchronism signal and for generating a switching signal at each vertical synchronism signal, the switching signal being supplied to the data selector so that the data selector responds to the switching signal to alternately select the first and second continuous frames or field of display data at each frame or field, a shift register connected to serially receive the display data outputted from the data selector in synchronism with a clock pulse so as to accumulate one frame or field of display data, a latch circuit coupled to receive in parallel the one frame or field of display data held in the shift register and to hold the received one frame or field of display data during each horizontal scan period, a plurality of column drivers each having an input connected through a gate circuit to one of parallel outputs of the latch circuit and also having an output connected to a corresponding one of the column electrodes of the display device, a row signal generator connected to receive a horizontal synchronism signal and having a plurality of parallel outputs, which are connected through row drivers to corresponding row electrodes of the display device, the row signal generator responding to the horizontal synchronism signal so as to selectively activate only one of the parallel outputs for each one horizontal scan, and a controller connected to receive a count value of the counter for controlling the open and close of the gate circuits during each horizontal scan period in such a manner that in at least each two continuous frames or fields, a open period of the gate circuits for one of the two continuous frames or fields is different from that of the gate circuits for the other of the two continuous frames or fields.

The above and other objects, features and advantages of the present invention will be apparent from the following description of preferred embodiments of the invention with reference to the accompanying drawings.

DESCRIPTION OF THE PREFERRED EMBODIMENTS

Figure 1:
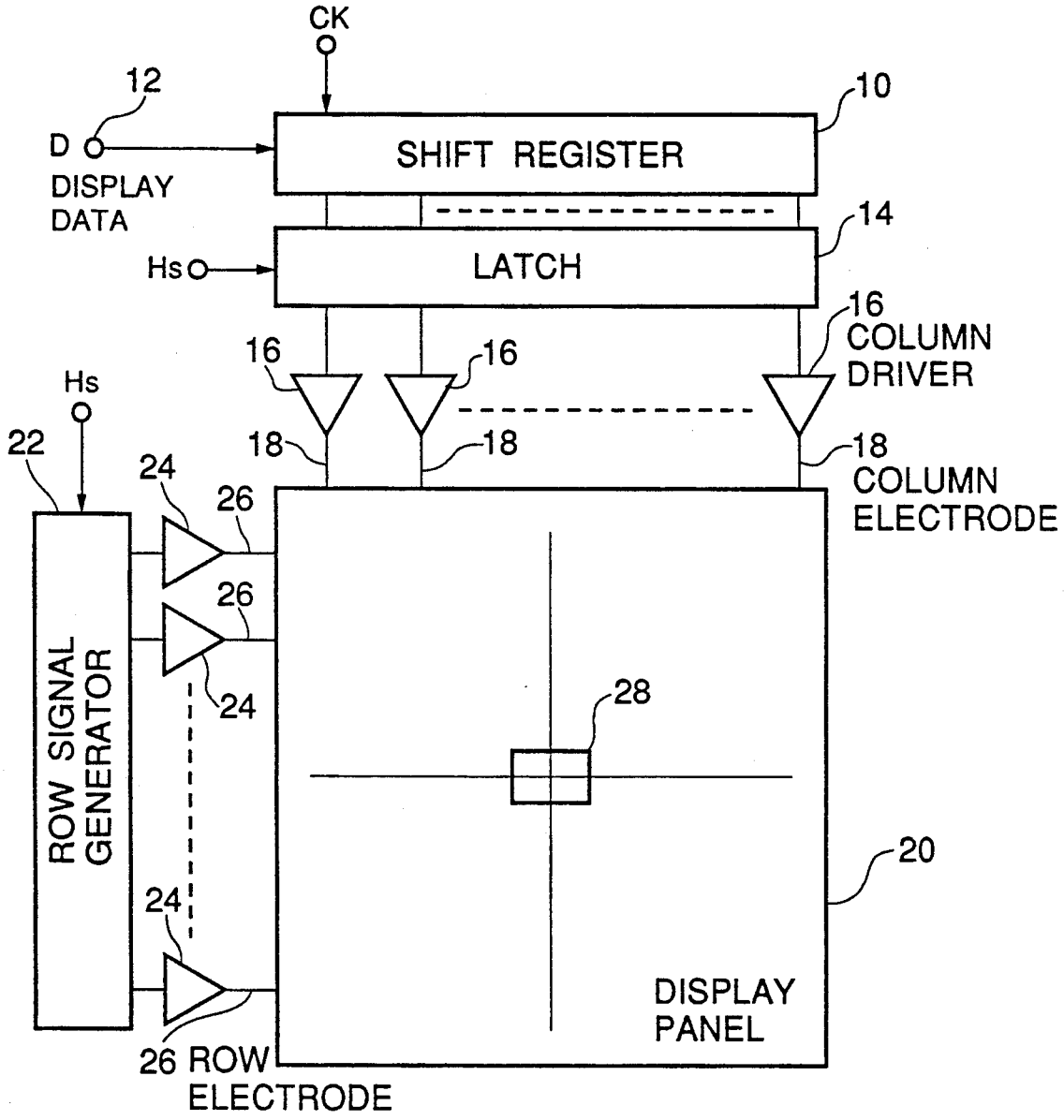
FIGURE 1 PRIOR ART
FIG. 1 is a block diagram of one conventional typical drive circuit for the two-dimensional display panel.
Figure 2:
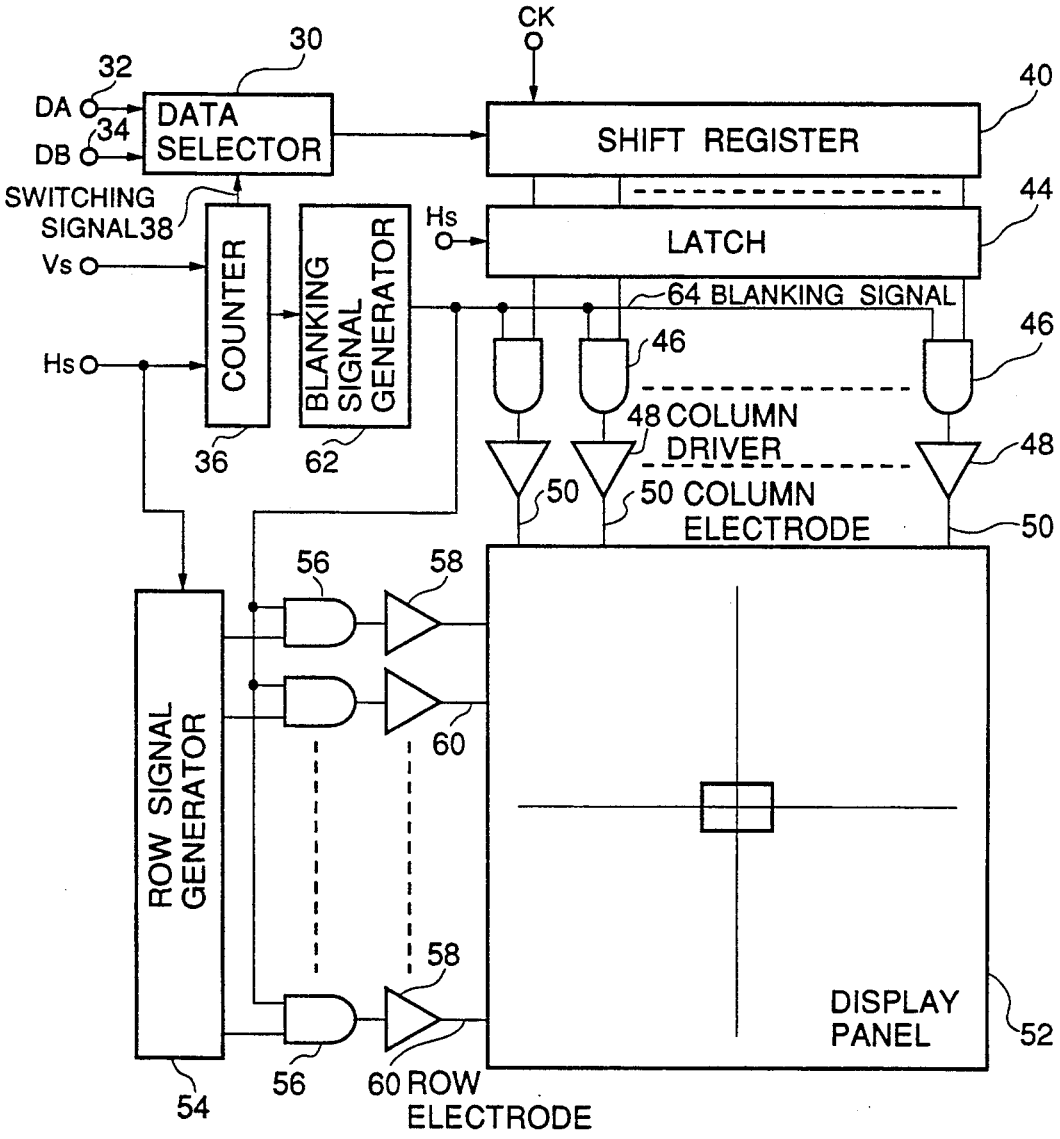
FIG. 2 is a diagram similar to FIG. 1, but showing one embodiment of the drive circuit for the two-dimensional display panel in accordance with the present invention.

Referring to FIG. 2, there is shown a diagram of one embodiment of the drive circuit for the two-dimensional display panel in accordance with the present invention. The shown circuit comprises a data selector 30 having two inputs connected to a pair of data input ports 32 and 34, respectively. The input port 32 and 34 are supplied with two continuous frame (or fields) of display data DA and DB, respectively. Namely, each set of two continuous frames of display data DA and DB will form one complete display image. Furthermore, there is provided a counter 36 connected to receive a vertical synchronism signal Vs. The counter 36 counts the received vertical synchronism signal Vs for generating a switching signal 38 at each vertical synchronism signal Vs, namely at each time the frame is changed. Thus, the data selector 30 responds to the switching signal 38 to alternately select the two continuous frames of display data DA and DB at each frame (or field). The display data outputted from the data selector 30 is inputted to a serial input of a shift register 40 and sequentially accumulated in the shift register 40 in synchronism with a clock pulse CK. Thus, the display data DA or DB corresponding to one horizontal line or row is accumulated in the shift register 40. The shift register 40 having parallel outputs connected to a latch circuit 44, so that the display data of one horizontal line or row held in the shift register 40 is transferred in parallel to and latched by the latch circuit 44 in synchronism with the horizontal scan or synchronism signal Hs and held in the latch circuit 44 during a one horizontal scan period. Each bit of the latch circuit 44 is connected through an AND gate 46 to an input of a corresponding column driver 48, which applies or does not apply a voltage to a corresponding column electrodes 50 of a display panel 52 in accordance with a binary value held in the corresponding bit of the latch circuit 44.

The shown drive circuit also includes a row signal generator 54 connected to receive the horizontal synchronism or scan signal Hs and having a plurality of parallel outputs, which are connected through AND gates 56 and row drivers 58 to corresponding row electrodes 60 of the display panel 52. Thus, the row signal generator 54 responds to the horizontal synchronism or scan signal Hs so as to selectively activate only one of the parallel outputs for each one horizontal scan so that only the row driver connected to the activated output of the row signal generator 54 applies a voltage to the corresponding one row electrode.

Furthermore, a count output of the counter 36 is supplied to a blanking signal generator 62 in synchronism with the horizontal scan signal Hs. This blanking signal generator 62 operates to generate a brightness modification signal on the basis of a count value of the counter 36 supplied in synchronism with each horizontal scan signal Hs. This signal will be called a "blanking signal" hereinafter, since the shown embodiment is intended to change the brightness of the whole of the display screen by controlling a period during which a display pixel is not fired, namely, a pixel non-firing period. This period will be called a "blanking period". This blanking signal 64 is applied to the remaining input of each of the AND gates 46 and 56, so that the passage of the display data signal and the row selection signal is controlled by these AND gates 46 and 56.

With the above mentioned embodiment, at each time the vertical synchronism signal Vs is applied to the counter 36, the counter 36 counts vertical synchronism signal Vs. In this embodiment, it is sufficient if the counter can take two states of "0" and "1", and therefore, the counter 36 can be formed by using a flipflop circuit. When the output of the counter 36 is "1" indicative of an odd frame, the data selector 30 selects the display data DA, and on the other hand, when the output of the counter 36 is "0" indicative of an even frame, the data selector 30 selects the display data DB. The selected display data of one horizontal row or line is sequentially written and accumulated into the shift register 40 in synchronism with the clock CK for one horizontal scan period. The display data accumulated in the shift register is transferred and latched into the latch circuit 44 in synchronism with a next horizontal scan signal Hs.

Figure 3:
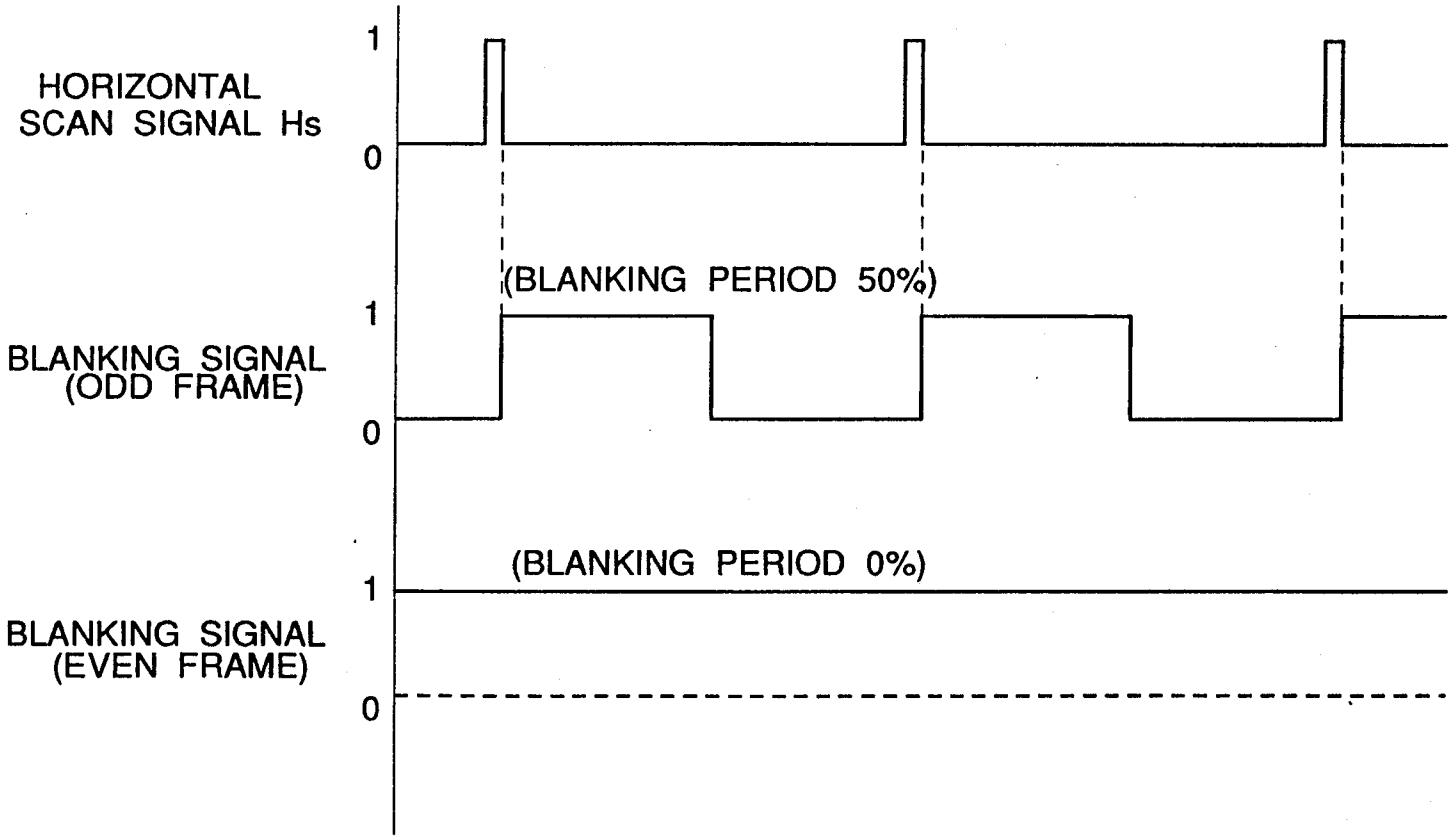
FIG. 3 is a waveform diagram illustrating an operation of the circuit shown in FIG. 2.

The count value of the counter 36 is outputted to the blanking signal generator 62 in synchronism with each horizontal scan signal Hs, and the blanking signal generator 62 generates the blanking signal 64 as shown in FIG. 3. For example, when the count value of the counter 36 is "1" indicative of the odd frame, the blanking signal generator 62 generates a blanking signal which gives a blanking period of 50% in each one horizontal scan period. On the other hand, when the count value of the counter 36 is "0" indicative of the even frame, the blanking signal generator 62 generates a blanking signal which gives a blanking period of 0% in each one horizontal scan period. In the shown embodiment, namely, the display data DA corresponds to the 50% blanking period, and the display data DB corresponds to the 0% blanking period. As mentioned hereinbefore, one complete image or picture is formed by two frames of image, which are formed by one pair of the display data DA and the display data DB.

Here, assuming that the blanking period is 50% in one vertical synchronism or scan period for the display data DA, and the blanking period is 0% in a next vertical synchronism or scan period for the display data DB, the blanking period of 50% and the blanking period of 0% will alternately appear in a sequence of vertical scan periods. In this case, if both of the display data DA and the display data DB are a firing data, the displayed image will have a maximum brightness. If the display data DA is a non-firing data and the display data DB is a firing data, the displayed image will have a second brightness which is lower than maximum brightness but higher than two levels of brightness explained hereinafter. If the display data DA is a firing data and the display data DB is a non-firing data, the displayed image will have a third brightness which is lower than the second brightness. If both of the display data DA and the display data DB are a non-firing data, the displayed image will have a minimum or darkest brightness. Thus, four levels of brightness can be obtained.

Therefore, assuming that the blanking period for the data DA is $\alpha$ % and the blanking period for the data DB is $\beta$ % and $\alpha > \beta$, four levels of brightness modulation can be obtained as shown in the following table:

| Data DA | Data DB | Modulation Rate |
|---|---|---|
| (1) non-firing | non-firing | 0% |
| (2) firing | non-firing | $\frac{(100-\alpha)}{(100-\alpha)+(100-\beta)} \times 100\%$ |
| (3) non-firing | firing | $\frac{(100-\beta)}{(100-\alpha)+(100-\beta)} \times 100\%$ |
| (4) firing | firing | 100% |

In the above mentioned embodiment, it is set that $\alpha = 50\%$ and 62 $= 0\%$, and therefore, the brightness modulatio rate will be 0% in the first case (1) of the above table, 33.3% in the second case (2), 66.6% in the third case (3) and 100% in the fourth case (4).

Incidentally, in the above mentioned embodiment, the brightness has been modulated with four different levels. However, if two or more different blanking signals are generated, it is possible to obtain more different levels of brightness.

The embodiment shown in FIG. 2 can be applied for driving a liquid crystal display panel, an LED display panel and an EL (electroluminescence) display panel.

Figure 4:
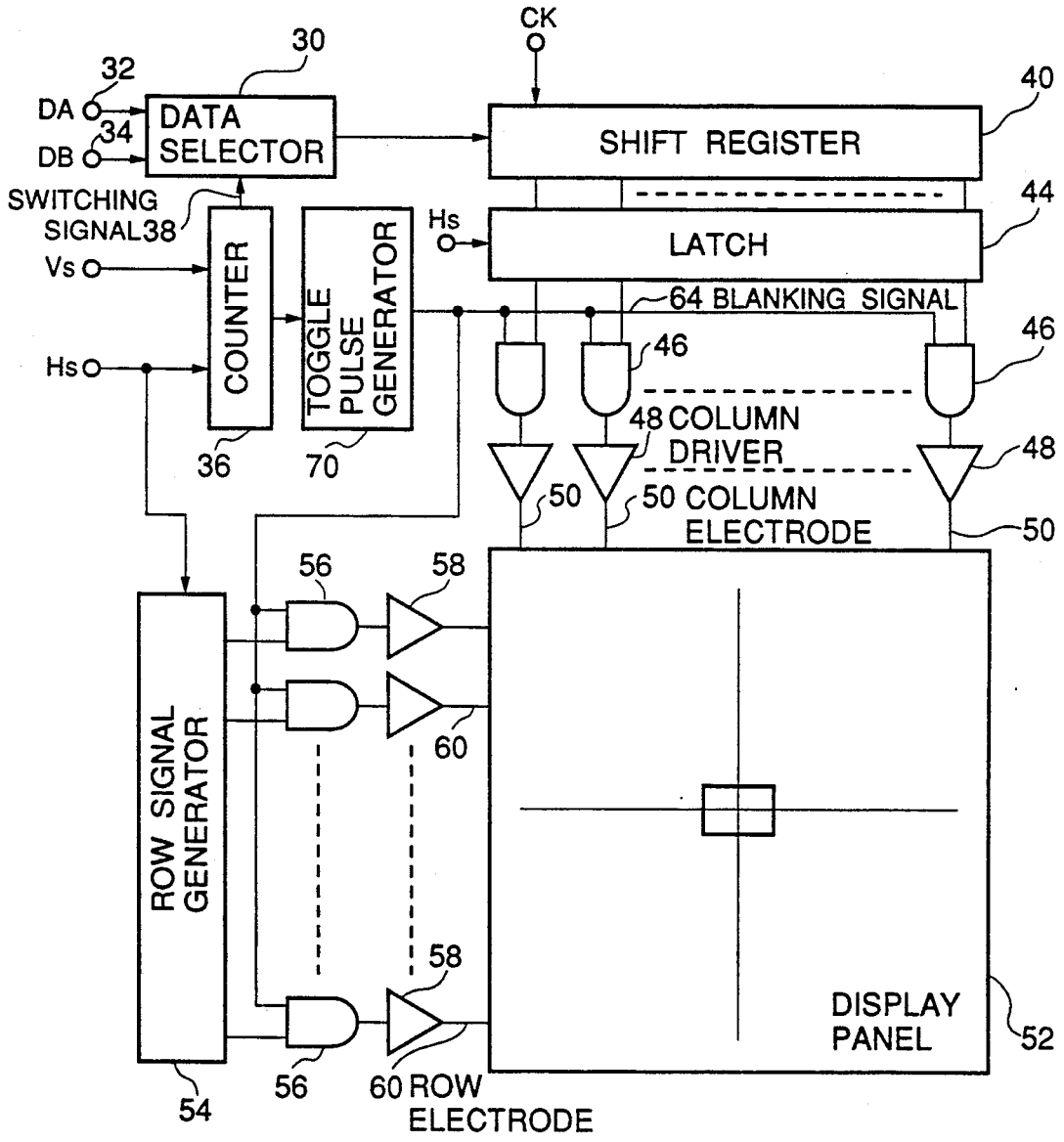
FIG. 4 is a diagram similar to FIG. 1, but showing another embodiment of the drive circuit for the two-dimensional display panel in accordance with the present invention.

Referring to FIG. 4, there is shown an embodiment of the display drive circuit suitable to a plasma display panel. The shown embodiment is adapted to realize the multilevel display method of the present invention by controlling a frequency of a so-called toggle pulse. In FIG. 4, circuit elements similar to those shown in FIG. 2 are given the same Reference Numerals, and therefore, explanation thereof will be omitted.

As seen from comparison between FIGS. 2 and 4, the embodiment shown in FIG. 4 has a toggle pulse generator 70 in place of the blanking signal generator 62. The toggle pulse generator 70 operates on the basis of the count value of the counter 38 so as to generate a toggle pulse of a frequency $f_A$ for the display period of the data DA (namely the odd frame) and a toggle pulse of a frequency $f_B$ for the display period of the data DB (namely the even frame). Here, it is set that $f_A$ is less than $f_B$.

In the plasma display panel, the higher the frequency of the toggle pulse is, the higher the brightness becomes. With the above mentioned arrangement, therefore, if both of the data DA and the data DB are a firing data, the display panel will give a highest brightness. If the data DA is a non-firing data and the data DB is a firing data, the resultant image is displayed at a second bright brightness. Further, if the data DA is a firing data and the data DB is a non-firing data, the display panel is fired at a third bright brightness. If both of the data DA and the data DB are a non-firing data, the display panel will give a lowest brightness.

The invention has thus been shown and described with reference to the specific embodiments. However, it should be noted that the present invention is in no way limited to the details of the illustrated structures but changes and modifications may be made within the scope of the appended claims.

We claim:

1. A method for displaying an image having more than two different brightness levels in a line sequential scanning type of a binary image display device in which an image is displayed by sequentially activating scan lines one by one, and in which one complete display image is formed by at least a plurality of continuous frames or fields, said display device having an orthogonal array of column and row electrodes, pixels being formed at intersections in said orthogonal array, each of said electrodes having an individually associated driver, said method comprising the steps of:

(a) changing a brightness of the whole display screen in units of one frame or field during each one period corresponding to one frame or field, and (b) logically multiplying all column drive video signals which are to be applied to a series of column drivers with a selected one of a plurality of brightness level signals, said logical multiplication being with the same selected one of the plurality of brightness level signals;

(c) applying said signals which are logically multiplied in step (b) through a series of column drivers to corresponding column electrodes of the display device, respectively; and (d) applying said signals which are logically multiplied in step (b) through a series of row drivers to each of all row so that the respective logically multiplied row drive video signals are applied through the series of row drivers to corresponding row electrodes of the display device, respectively, whereby each display pixel can have a brightness level which is respectively defined by combinations of brightness levels given by an input display data and the selected one of said plurality of brightness levels of the whole of the display screen.

2. A method claimed in claim 1, wherein said plurality of brightness level signals are composed of at least two blanking signals having different inactive periods.

3. A method in claim 1 wherein said plurality of brightness level signals are composed of at least two toggle pulses having frequencies which are different from each other.

4. A circuit for displaying an image having more than two different brightness levels in a line sequential scanning type of binary image display device in which an image is displayed by sequentially activating scan lines one by one, one complete display image being formed by at least first and second continuous alternating frames or fields of display data, the image display device having a plurality of row electrodes and a plurality of column electrodes intersecting with one another in a two-dimensional plane so that each intersecting point between the row electrodes and the column electrodes forms one pixel, said circuit comprising a data selector connected to receive first and second continuous alternating frames or fields of display data, respectively, a counter connected to receive a vertical synchronism signal for counting received vertical synchronizing signals and for generating a switching signal at each vertical synchronizing signal, the switching signal being supplied to the data selector so that the data selector responds to the switching signal to alternately select either the first or the second continuous frames or field of display data, the selection being made responsive to an occurrence of each frame or field, a shift register connected to serially receive the display data outputted from the data selector in synchronism with a clock pulse so as to accumulate one frame or field of display data, a latch circuit having a plurality of parallel outputs and being coupled to receive in parallel the one frame or field of display data held in the shift register and to hold the received frame or field of display data during each horizontal scan period, a plurality of column drivers each having an input connected through an AND gate circuit to a corresponding one of said parallel outputs of the latch circuit and also having an output connected to a corresponding column electrode of the display device, a row signal generator connected to receive a horizontal synchronizing signal and having a plurality of parallel outputs, a plurality of row drivers each having an input connected through an AND gate to a corresponding one of said parallel outputs of said row signal generator and having an output connected to a corresponding row of electrode of the display device, the row generator responding to the horizontal synchronizing signal so as to selectively activate only one of the parallel outputs for each one horizontal scan, and a controller connected to receive a count value of the counter for controlling the opening and closing of the AND gate circuits connected to said column driver and said row driver during each horizontal scan period in a manner such that in at least each two continuous frames or fields an open period of the AND gate circuits connected to said column driver and said row driver for one of the two continuous frames or fields is different from an open period of the gate circuits connected to said column driver and said row driver for the other of the two continuous frames or fields, the controller being composed of a blanking signal generator for alternately generating a first blanking signal for the first frame or field of display data and a second blanking signal for the second frame or field of display data, the first and second blanking signals having active periods which are different from each other, and each first and second blanking signals being generated in synchronism with the horizontal scan signal and for every horizontal scan period.

5. A circuit for displaying an image having more than two different brightness levels in a line sequential scanning type of binary image display device in which an image is displayed by sequentially activating scan lines one by one, one complete display image being formed by at least first and second continuous alternating frames or fields of display data, the image display device having a plurality of row electrodes and a plurality of column electrodes intersecting with one another in a two-dimensional plane so that each intersecting point between the row electrodes and the column electrodes forms one pixel, said circuit comprising a data selector connected to receive first and second continuous alternating frames or fields of display data, respectively, a counter connected to receive a vertical synchronism signal for counting received vertical synchronizing signals and for generating a switching signal at each vertical synchronizing signal, the switching signal being supplied to the data selector so that the data selector responds to the switching signal to alternately select either the first or the second continuous frames or field of display data, the selection being made responsive to an occurrence of each frame or field, a shift register connected to serially receive the display data outputted from the data selector in synchronism with a clock pulse so as to accumulate one frame or field of display data, a latch circuit having a plurality of parallel outputs and being coupled to receive in parallel the one frame or field of display data held in the shift register and to hold the received frame or field of display data during each horizontal scan period, a plurality of column drivers each having an input connected through an AND gate circuit to a corresponding one of said parallel outputs of the latch circuit and also having an output connected to a corresponding column electrode of the display device, a row signal generator connected to receive a horizontal synchronizing signal and having a plurality of parallel outputs, a plurality of row drivers each having an input connected through an AND gate to a corresponding one of said parallel outputs of said row signal generator and having an output connected to a corresponding row electrode of the display device, the row generator responding to the horizontal synchronizing signal so as to selectively activate only one of the parallel outputs for each one horizontal scan, and a controller connected to receive a count value of the counter for controlling the opening and closing of the AND gate circuits connected to said column driver and said row driver during each horizontal scan period in a manner such that in at least each two continuous frames or fields an open period of the AND gate circuits for one of the two continuous frames or fields is different from an open period of the AND gate circuits connected to said column driver and said row driver for the other of the two continuous frames or fields, the controller being composed of a toggle pulse generator for alternately generating a first toggle pulse for the first frame or field of display data and a second toggle pulse for the second frame or field of display data, the first and second toggle pulses having frequencies which are different from each other, and each first and second toggle pulses being generated in synchronism with the horizontal scan signal and for every horizontal scan period.

* * * * *